US005921869A

United States Patent [19]

Blough et al.

[11] Patent Number: 5,921,869

[45] **Date of Patent: *Jul. 13, 1999**

[54] PERIMETER WEIGHTED IRON TYPE GOLF CLUB HEADS WITH MULTIPLE LEVEL WEIGHT PADS

[75] Inventors: Robert Thomas Blough, Mineral; Ronie Foy McGraw, Glen Allen, both of Va.; Donald Steven Rahrig, Arlington, Tex.

[73] Assignee: Lisco, Inc., Tampa, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,701

[22] Filed: May 27, 1997

Related U.S. Application Data

[63] Continuation of application No. 08/702,773, Aug. 22, 1996, abandoned.

[51] Int. Cl.[6] ..... A63B 53/04

[52] U.S. Cl. ..... 473/291; 473/350

[58] Field of Search ..... 473/349, 350, 473/334–339, 290–292

[56] References Cited

U.S. PATENT DOCUMENTS

| | | | |
|---|---|---|---|
| D. 328,322 | 7/1992 | Antonious . | |
| D. 355,234 | 2/1995 | McNally et al. . | |
| D. 362,041 | 9/1995 | Takahashi et al. . | |
| D. 362,481 | 9/1995 | Takahasi et al. . | |
| D. 363,332 | 10/1995 | Krzynowek et al. . | |
| 4,826,172 | 5/1989 | Antonious . | |
| 4,907,806 | 3/1990 | Antonious . | |
| 4,915,386 | 4/1990 | Antonious | 473/350 |
| 4,919,430 | 4/1990 | Antonious . | |
| 4,919,431 | 4/1990 | Antonious | 473/350 |
| 4,932,658 | 6/1990 | Antonious | 473/350 |
| 4,938,470 | 7/1990 | Antonious | 473/350 |
| 5,014,993 | 5/1991 | Antonious . | |
| 5,026,056 | 6/1991 | McNally et al. | 473/350 |
| 5,046,733 | 9/1991 | Antonious | 473/350 |
| 5,048,834 | 9/1991 | Gorman . | |
| 5,242,167 | 9/1993 | Antonious . | |
| 5,290,032 | 3/1994 | Fenton et al. . | |
| 5,328,184 | 7/1994 | Antonious . | |
| 5,333,872 | 8/1994 | Manning et al. . | |
| 5,395,133 | 3/1995 | Antonious . | |
| 5,447,307 | 9/1995 | Antonious . | |

*Primary Examiner*—Mark S. Graham
*Attorney, Agent, or Firm*—Martin Smolowitz

[57] ABSTRACT

A golf club head set having the club head back side divided into four areas, including the perimeter weighted region A; the sweet spot area B located directly behind the ball striking area, two separated non-striking areas C, and the low central region D. The sweet spot area B is further divided into three distinct weight levels, and the low central region D is divided into four additional weight levels. By adding and dropping weight levels as well as by changing the thickness of the levels, the weight distribution of each club head is changed so as to control center of gravity and polar moment of inertia and provide gradated performance specific to each club head in the set.

5 Claims, 4 Drawing Sheets

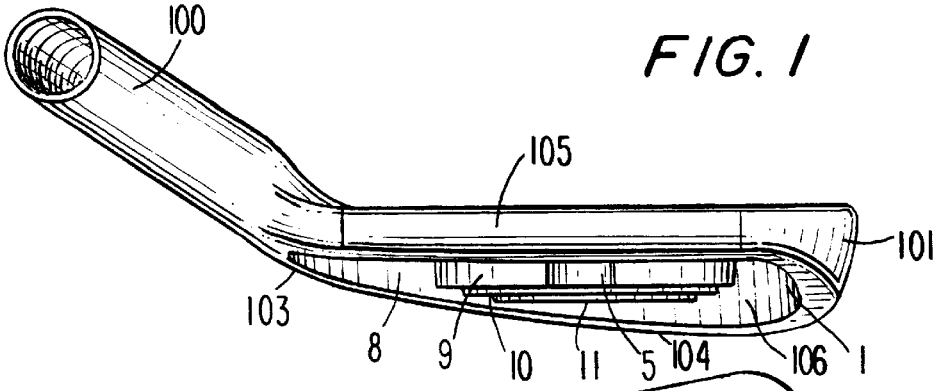
FIG. 1
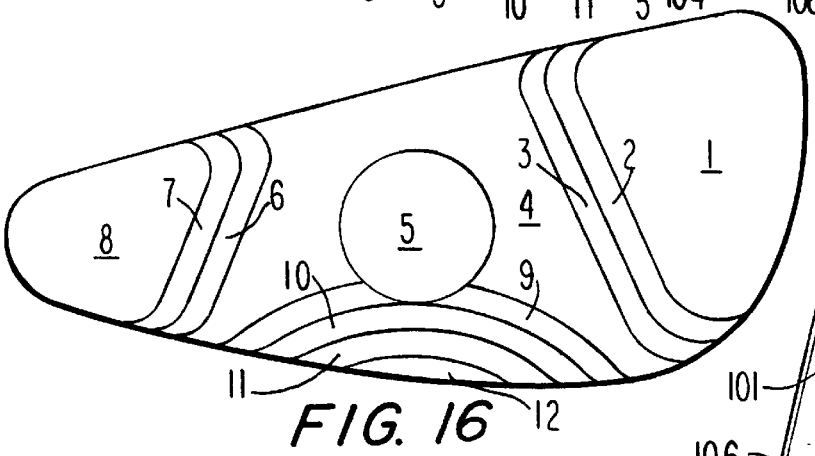
FIG. 16
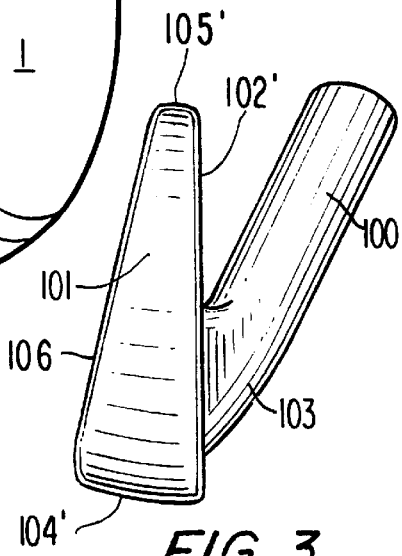
FIG. 3
FIG. 2
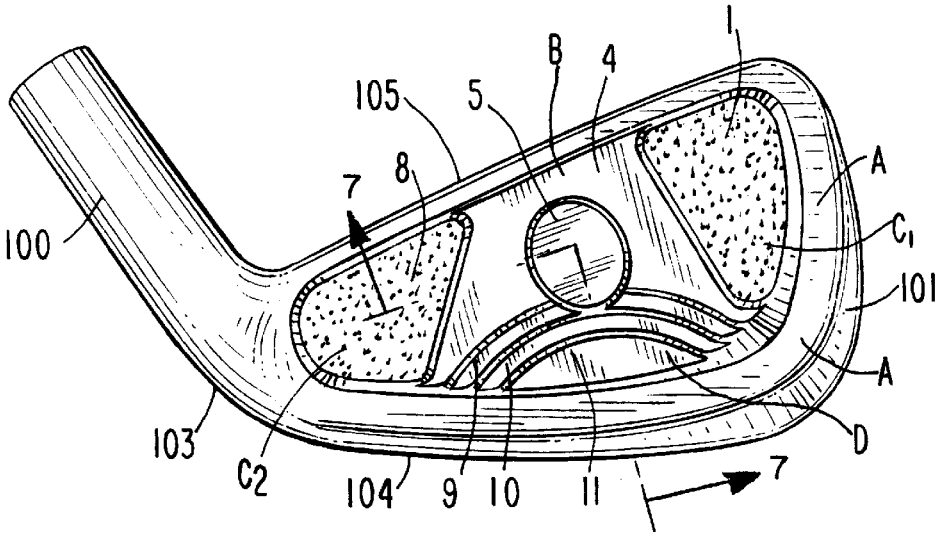

FIG. 4
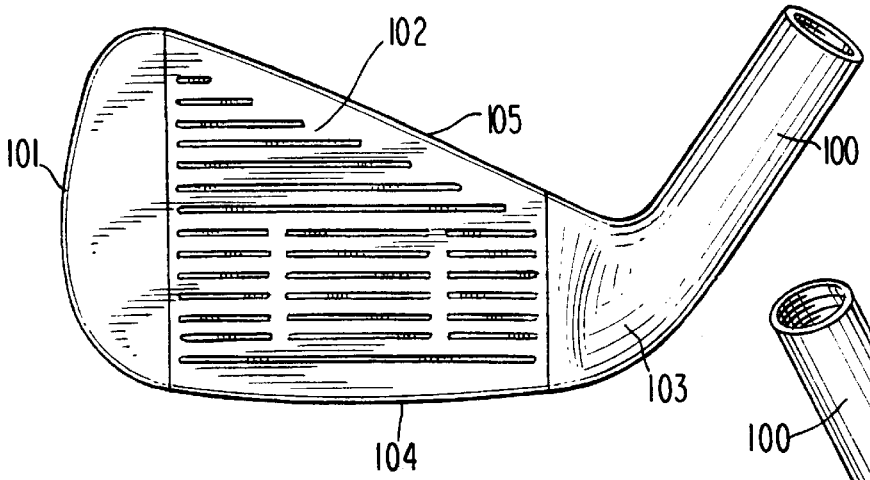
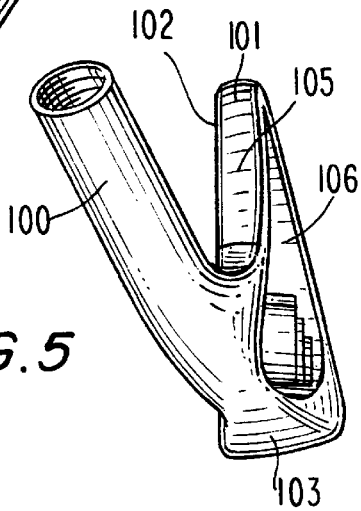
FIG. 5
FIG. 6
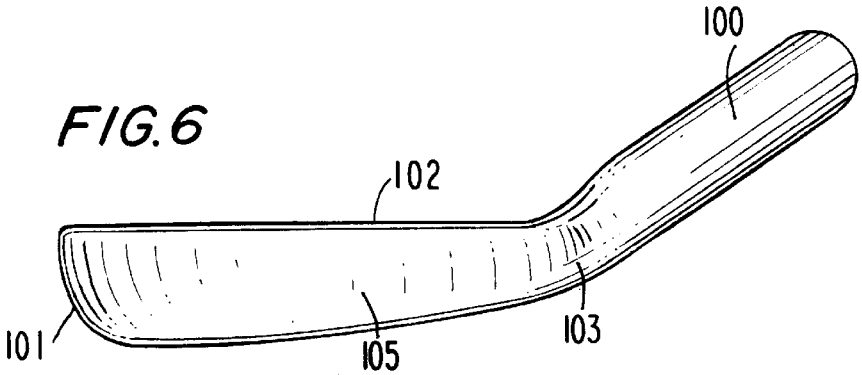
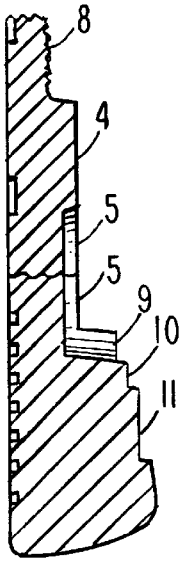
FIG. 7

FIG. 8
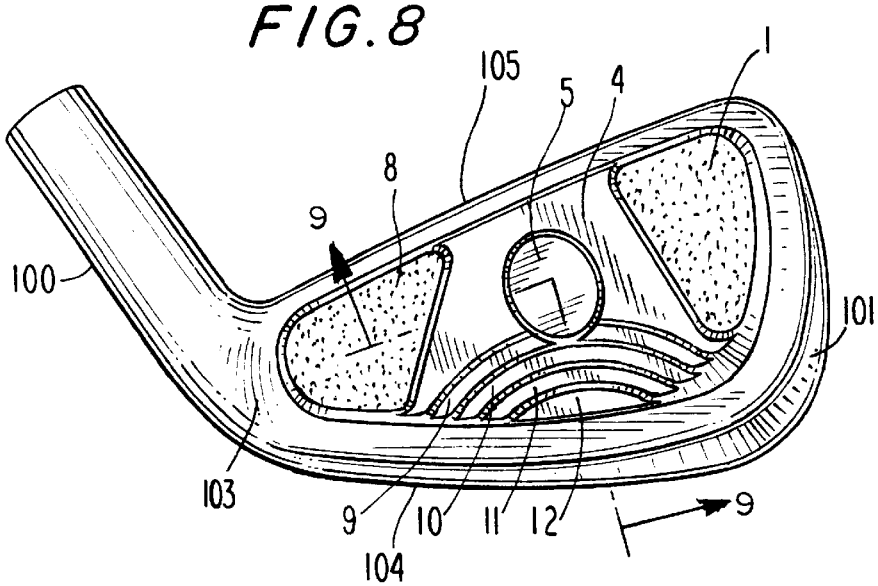
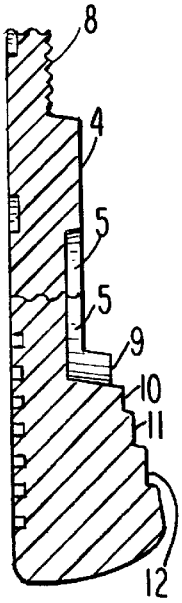
FIG. 9
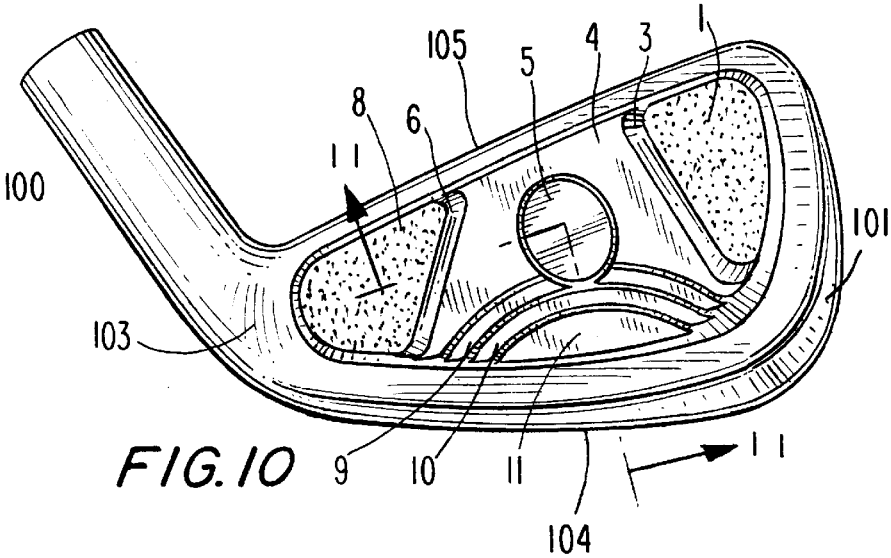
FIG. 10
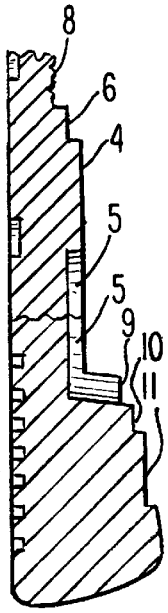
FIG. 11

FIG. 12
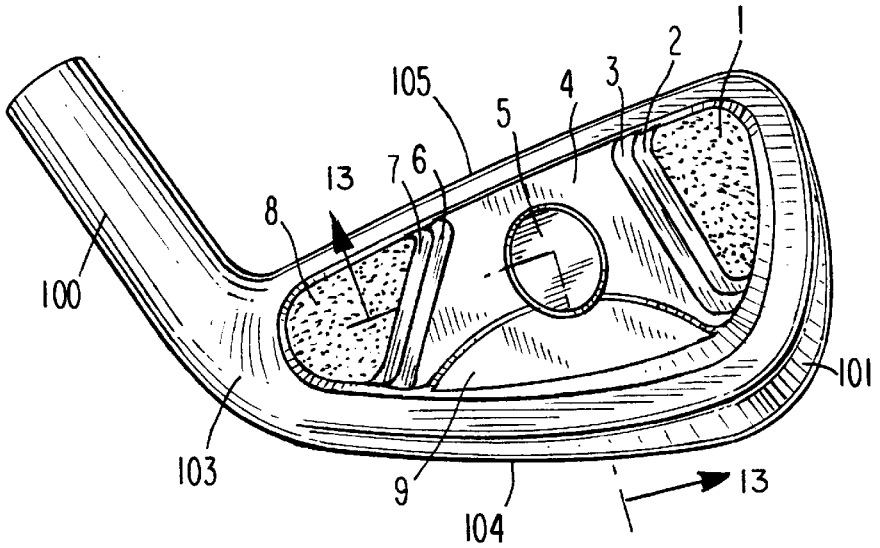
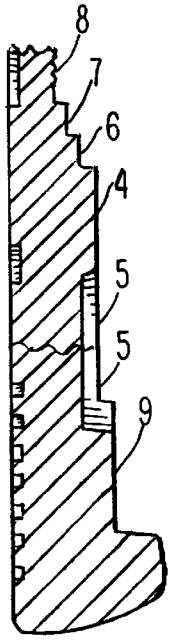
FIG. 13
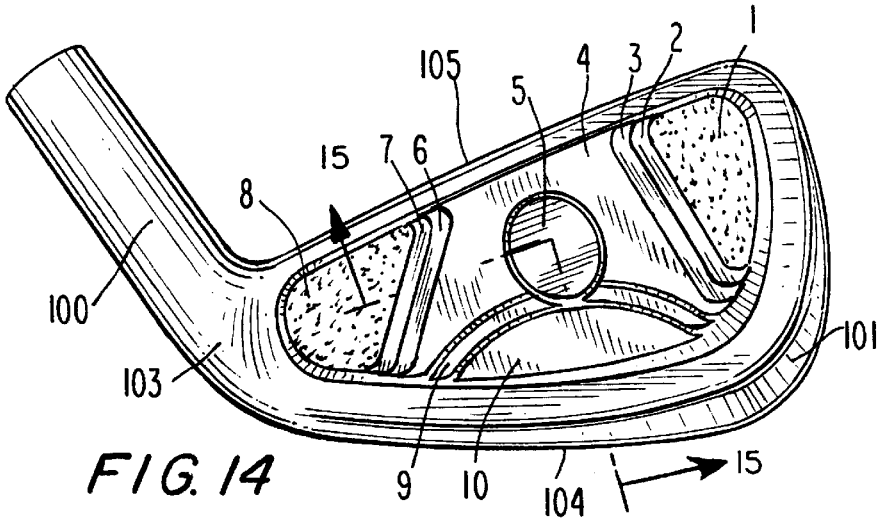
FIG. 14
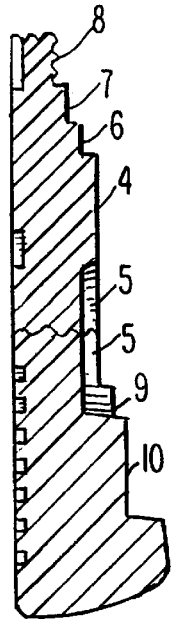
FIG. 15

PERIMETER WEIGHTED IRON TYPE GOLF CLUB HEADS WITH MULTIPLE LEVEL WEIGHT PADS

This application is a continuation of application Ser. No. 08/702,773, filed Aug. 22, 1996, abandoned.

BACKGROUND OF INVENTION

1. Field of Invention

This invention relates to perimeter weighted iron type golf club heads, and more particularly, to a set of perimeter weighted iron type golf club heads having a rear cavity containing a sequentially gradated secondary weight system.

2. Description of Prior Art

It has been common practice in recent years to provide iron type golf club heads with perimeter weighting by forming a cavity on the back side of the club head. Distributing the major portion of the club head weight around the perimeter of the club head results in a lower center of gravity and increased polar moment of inertia (PMI) for the club. The lower center of gravity has the effect of increasing the trajectory of the resultant ball flight after being hit by the club head and making the lower lofted irons easier to use for hitting the ball. The increased polar moment of inertia causes the club head to resist twisting at the moment of impact with a ball during an off center hit, resulting in a more forgiving club. This feature has been a boon to encouraging newer players to participate in the sport.

Unfortunately, lowering the club head center of gravity also increases the ball trajectory for the higher lofted clubs. This increased altitude causes the ball flight to be more susceptible to effects of the wind, and a subsequent loss in precision for golf players. The increased polar moment of inertia makes it harder for the better player to "work" the ball advantageously in his/her short game. It also has the undesirable effect of reducing the club head "sweet spot", which in turn reduces the amount of positive feedback the player receives from the club. In general, expertly and poorly struck balls feel the same to the player. This lack of differentiation deprives the player of feedback information needed to continue to improve his game skill.

In order to overcome the basic disadvantages of perimeter weighted golf clubs, many attempts have been made to improve the weight distribution by including in the rear cavity formed by the perimeter weighting some type of auxiliary weighting of various structural forms. Pertinent examples of this type of golf club head are disclosed in U.S. Pat. Nos. 4,826,172; 4,907,806; 4,919,430; 5,014,993; 5,048,834; 5,242,167; 5,328,184 and 5,395,113 to Antonious, and U.S. Pat. No. 5,333,872 to Manning et al;. Also, U.S. Pat. Nos. 328,322 and 363,332 show similar perimeter weighted golf club head designs.

The present invention advantageously enhances the positive aspects while reducing undesirable side effects of perimeter weighted iron type golf club heads with a back cavity, and has additional gradated weight members provided within the cavity.

SUMMARY OF INVENTION

The object of the present invention is to provide a set of perimeter weighted iron type golf club heads which set include highly perimeter weighted long irons with expanded sweet spots for the shorter irons. This improved result for each club head in the set is accomplished through a unique system of gradated weight pads provided in the rear cavity formed by the perimeter weighting of the club head.

The back side of each club head body is divided into four regions, including the perimeter weighted region A, the central sweet spot region B located directly behind the ball striking area, two non-striking regions C each located near each end of the club head, and the low central region D. The sweet spot region B is further divided into three distinct weighted levels, and the low central region D has been divided into four additional area weighted levels. By adding and dropping area weight levels as well as by changing the thickness of the different weight levels, the weight distribution of each club head in the set is changed so as to sequentially raise the center of gravity and reduce the polar moment of inertia, and thereby tailor improved gradated performance specific to each club in the set.

BRIEF DESCRIPTION OF THE DRAWINGS

This invention will be described further with reference to the following drawings, in which:

FIG. 1 is a perspective view of the top of one embodiment of a club head according to the present invention, showing different levels of the area weighted pads on the club head back side;

FIG. 2 is a perspective view of the back side of the club head embodiment of FIG. 1;

FIG. 3 is a perspective view of the toe end of the club head embodiment of FIG. 1;

FIG. 4 is a perspective view of the front side surface of the club head embodiment of FIG. 1;

FIG. 5 is a perspective view of the heel portion of the club head embodiment of FIG. 1;

FIG. 6 is a perspective view of the top of the club head embodiment of FIG. 1;

FIG. 7 is a sectional view taken along line 7—7 of FIG. 2 and showing the sequentially varying area weight pad levels;

FIG. 8 is a perspective view of the back side of a second embodiment of the club head according the present invention;

FIG. 9 is a sectional view taken along line 9—9 of FIG. 8;

FIG. 10 is a perspective view of the back side of a third embodiment of the club head according to the present invention;

FIG. 11 is a sectional view taken along line 11—11 of FIG. 10;

FIG. 12 is a perspective view of the back side of a fourth embodiment of the club head according to the present invention;

FIG. 13 is a sectional view taken along line 13—13 of FIG. 12;

FIG. 14 is a perspective view of the back side of a fifth embodiment according the present invention;

FIG. 15 is a section view taken along line 15—15 of FIG. 14; and

FIG. 16 is a diagram showing an outline of the various regions of the rear cavity area of the set of club heads with the various area weight pad levels being numbered sequentially from the toe to the heel end and from the central sweet spot region B downwardly to the central bottom edge of the club head according to the invention.

DESCRIPTION OF PREFERRED EMBODIMENTS

As shown in the FIGS. 1–6, 8, 10, 12 and 14 drawings, all of the club heads in the set include a hosel 100 attached onto a body including, a toe portion 101, a front portion 102, a heel portion 103, a bottom portion 104, and a top portion 105. The club head body also includes a front striking face on front portion 102 and a back side cavity 106, which includes the central sweet spot area and numbered area weight pad levels designated 1, 4, 5, 8 and 9 and optional area weight pad levels designated 2, 3, 6, 7, and 10–12 as shown by FIG. 16.

As generally indicated in FIG. 2, the golf club head back side is divided in four area regions including the outer perimeter weighted region A, the central "sweet-spot" region B, the two non-striking regions $C_1$ and $C_2$ located near the toe and heel ends of the club head, respectively, and the lower central region D. The number, thickness and area of each weight pad area or level is varied so as to sequentially raise the center of gravity of the club head, increase the sweet spot area and reduce the polar moment of inertia (PMI) for each designated club in the set.

As shown in FIGS. 10, 12, 14 and 16, the area weight pad levels designated 2 and 3 are located between the central sweet spot region B (or level 4) and the toe end of the club head, and the area weight pad levels 6 and 7 are located between the central sweet spot region B (level 4) and the heel end of the club head. The area weight pad levels 2 and 7 each have a thickness which is increased relative to that of areas 1 and 8 located in the non-striking zones $C_1$ and $C_2$, respectively. Also, the area weight pad levels 3 and 6 located adjacent to the central sweet spot region B each have a thickness which is increased relative to that of their respective adjacent areas 2 and 7, but is less than the thickness of the central sweet spot area 4. However, the center area weight pad level 5 is recessed relative to its surrounding area level 4.

Also, the other designated area weight pad levels 9, 10, 11 and 12 each have a similar arcuate shape, and are located between the central sweet spot region B and the bottom portion or edge of the club head. Each of these pad levels 9, 10, 11 and 12 has a thickness which is increased sequentially relative to that of the adjacent above located area weight pad level of the club head body. Specifically as shown by FIGS. 1, 7, 9 and 11, the thickness of area weight pad level 9 exceeds that of the central area pad level 4, the thickness of area pad level 10 exceeds that of the adjacent above located area pad level 9, the thickness of area pad level 11 exceeds that of the adjacent area above located pad level 10, and the thickness of area pad level 12 exceeds that of the adjacent above located area pad level 11.

For the set of 14 gradated club heads according to the present invention sequentially designated 1–9 plus P, F, S, L and H, the areas of the various numbered area weight pad levels are listed in Table 1 below, with the numbered areas 1–12 being given in square centimeter ($CM^2$) units.

TABLE 1

| Area Weight | CLUB HEAD DESIGMATION $CM^2$ | | | | | |
|---|---|---|---|---|---|---|
| Level | 1 | 2 | 3 | 4 | 5 | 6 |
| 1 | 6.725 | 7.311 | 7.285 | 6.401 | 6.710 | 5.751 |
| 2 | N/A | N/A | N/A | N/A | N/A | N/A |
| 3 | N/A | N/A | N/A | N/A | N/A | 1.169 |
| 4 | 5.500 | 5.660 | 5.594 | 5.742 | 5.761 | 5.761 |
| 5 | 1.769 | 1.769 | 1.769 | 1.769 | 1.769 | 1.769 |
| 6 | N/A | N/A | N/A | N/A | N/A | 0.767 |
| 7 | N/A | N/A | N/A | N/A | N/A | N/A |
| 8 | 3.617 | 3.684 | 3.407 | 3.942 | 3.994 | 2.953 |
| 9 | 0.939 | 1.015 | 0.982 | 1.088 | 1.131 | 1.109 |
| 10 | 0.764 | 0.947 | 0.80O | 1.011 | 1.056 | 1.028 |
| 11 | 0.538 | 0.653 | 0.570 | 1.075 | 1.253 | 1.095 |
| 12 | 0.212 | 0.237 | 0.253 | N/A | N/A | N/A |

TABLE 1-continued

| Area Weight | CLUB HEAD DESIGMATION | | | | | | | |
|---|---|---|---|---|---|---|---|---|
| Level | 7 | 8 | 9 | P | F | S | L | H |
| 1 | 5.275 | 5.213 | 5.322 | 4.125 | 4.146 | 3.713 | 3.947 | 3.257 |
| 2 | N/A | N/A | N/A | 1.215 | 1.030 | 1.115 | 0.902 | 1.127 |
| 3 | 1.182 | 1.175 | 1.126 | 1.163 | 1.031 | 1.092 | 0.911 | 1.143 |
| 4 | 5.791 | 5.921 | 5.793 | 5.830 | 5.368 | 5.609 | 4.954 | 4.928 |
| 5 | 1.769 | 1.769 | 1.769 | 1.769 | 1.769 | 1.769 | 1.769 | 1.769 |
| 6 | 0.789 | 0.790 | 0.788 | 0.716 | 0.626 | 0.719 | 0.603 | 0.637 |
| 7 | N/A | N/A | N/A | 0.780 | 0.677 | 0.720 | 0.656 | 0.707 |
| 8 | 3.226 | 2.793 | 2.886 | 2.050 | 1.825 | 2.107 | 1.829 | 1.629 |
| 9 | 1.103 | 1.198 | 1.150 | 1.154 | 0.878 | 3.132 | 1.357 | 1.369 |
| 10 | 1.037 | 2.779 | 2.375 | 2.523 | 1.139 | N/A | N/A | N/A |
| 11 | 1.153 | N/A | N/A | N/A | N/A | N/A | N/A | N/A |
| 12 | N/A | N/A | N/A | N/A | N/A | N/A | N/A | N/A |

Note: N/A mean not applicable

In the long iron clubs, for club heads designated Nos. 1–3, there is one weight pad level 4 provided in the central sweet spot region B and all four area weight pad levels 9–12 are provided in the low central region D, as shown in FIG. 8. The weight pad level 4 in region B provides the club head with a well defined sweet spot region B. The central weight pad levels 9–12 in the low region D concentrate the remaining weight down below the center of the sweet spot for hitting a golf ball and, enhancing the club's ability to get the ball airborne after hitting it.

In club heads Nos. 4 and 5, the area weight levels are moved higher and are more evenly distributed. This is accomplished by dropping the lowest weight pad level 12 relative to the ground, and dividing its weight into the non-striking areas 1 and 8 as shown in FIG. 2. The increase in weight of areas 1 and 8 and the related increase in thickness of these areas moves the center of gravity slightly upward towards the ball impact zone, increases the sweet spot area, and reduces the polar moment of inertia for the club head.

Club heads Nos. 6 and 7 have additional weight pad levels in areas 3 and 6 in the central region B, as shown in FIG. 10. This configuration further raises the center of gravity and widens the sweet spot area, which has the further effect of reducing the club head polar moment of inertia and enhancing the player's ability of "working the ball" to his/her advantage.

In club heads Nos. 8 and 9, the center of gravity is raised even further and the ball workability is increased by removing weight pad level 11 in the low central region D and redistributing the weight to non-striking areas 1 and 8. Club heads for the Pitching Iron P and Fairway Wedge F continue the trend by the addition of weight pad levels 2 and 7 in the central region B, as shown in FIG. 14.

Finally, the Lob Wedge L and High Wedges H complete the transition from highly perimeter weighted/low center of gravity club head irons to a club having more moderate weight distribution with a large area sweet spot. Removing area weight pad level 10 from the low central region D and leaving only the highest and widest level 9 in that area as in FIG. 12 provides the greatest "feel" for the club to the player.

Gradually and sequentially reducing the polar moment of inertia of the numbered club heads as they progress through the set creates long irons Nos. 1–3 with greater torsional rigidity at impact with the ball so as to provide improved forgiveness for off-center hits. The shorter irons Nos. 4–9 with the reduced polar moment of inertia and therefore reduced torsional rigidity, allow the player to hit open or closed face shots with much greater control than previously possible in a set of game improvement irons.

Manipulating the club head center of gravity locations by adding or removing the numbered area weight levels creates an impulse vector that has an upwardly directed vertical component in the long irons, thereby increasing the club's ability for getting the ball airborne. Club irons with large lofts provide no problem in getting the ball airborne and, in fact, extremely high ball trajectories can adversely affect hitting accuracy for these irons. This tendency for high ball trajectories is reduced with higher centers of gravity for the club head, and therefore smaller vertical components of the impulse vector.

Although this invention has been described broadly and also in terms of preferred embodiments, it is understood that variations may be made in the structure of the golf club heads as described above without departing from the nature of the invention as defined in the claims.

We claim:

1. A golf club set comprising a plurality of perimeter weighted iron type golf club heads, each of said heads comprising:

a hosel having an upper and a lower end;

a club head body having a toe end and a heel end, said club head body being attached at its heel end to the lower end of said hosel; said club head body having a center of gravity and a polar moment of inertia; and further comprising a substantially planar front striking face;

a back side located opposite said front striking face, and characterized by having an outer perimeter weighted region A, forming a cavity containing a central sweet spot region B, two non-striking regions C and a central low region D; and having a plurality of gradated area weight pad levels provided within said cavity; wherein the number and thickness of said area weight pad levels are varied so as to sequentially raise the center of gravity of the club head body, increase the central sweet-spot area, and reduce the polar moment of inertia for each successive increased club head designation number in the golf club set.

2. A set of golf club heads according to claim 1, wherein each said club head body has from 1 to 4 successively gradated area weight pad levels centered in the central low region D of said cavity between the toe end and heel end of the club head body.

3. A set of golf club heads according to claim 2, further comprising up to two additional area weight pad levels provided in the central sweet spot region B of said cavity.

4. A set of golf club heads according to claim 1, wherein the central sweet spot region B includes an area weight pad level 5 which is recessed relative to a surrounding area weight pad level 4.

5. A set of golf club heads according to claim 2, wherein the area weight pad levels in said central low region D are each arcuate shaped.

* * * * *